US006387312B1

(12) United States Patent
Roberts et al.

(10) Patent No.: US 6,387,312 B1
(45) Date of Patent: May 14, 2002

(54) MOLDING A POLISHING PAD HAVING INTEGRAL WINDOW

(75) Inventors: John V. H. Roberts, Newark, DE (US); Barry Scott Pinheiro, Media, PA (US); David B. James, Newark, DE (US)

(73) Assignee: Rodel Holdings Inc., Wilmington, DE (US)

( * ) Notice: Subject to any disclaimer, the term of this patent is extended or adjusted under 35 U.S.C. 154(b) by 0 days.

(21) Appl. No.: 09/666,418

(22) Filed: Sep. 20, 2000

Related U.S. Application Data

(62) Division of application No. 09/375,962, filed on Aug. 17, 1999, now Pat. No. 6,171,181.

(51) Int. Cl.[7] ..... B29B 7/00
(52) U.S. Cl. ..... 264/328.16; 264/348; 425/548
(58) Field of Search ..... 264/40.6, 327, 264/328.16, 348; 425/552, 548

(56) References Cited

U.S. PATENT DOCUMENTS 4,179,488 A * 12/1979 Nishikawa et al. ..... 264/521
4,564,497 A * 1/1986 Ota et al. ..... 264/521
4,728,559 A * 3/1988 Hardenbrook et al. ..... 264/321
5,182,070 A * 1/1993 Seifert et al. ..... 264/327
5,413,941 A 5/1995 Koos et al.
5,605,760 A 2/1997 Roberts
5,893,796 A 4/1999 Birang et al.
6,074,287 A 6/2000 Miyaji et al.
6,168,740 B1 * 1/2001 Koch et al. ..... 264/237

* cited by examiner

*Primary Examiner*—Jill L Heitbrink
(74) *Attorney, Agent, or Firm*—Gerald K. Kita; Konrad Kaeding; Kenneth A. Benson

(57) ABSTRACT

A polishing pad is formed by solidifying a flowable polymeric material at different rates of cooling to provide a polishing pad with a transparent region and an adjacent opaque region. Types of polymeric material suitable for making the polishing pad include a single thermoplastic material, a blend of thermoplastic materials, and a reactive thermosetting polymer.

5 Claims, 1 Drawing Sheet

MOLDING A POLISHING PAD HAVING INTEGRAL WINDOW

CROSS REFERENCE TO RELATED APPLICATION

This application is a Division of U.S. application Ser. No. 09/375,962, filed Aug. 17, 1999 now U.S. Pat. No. 6,171, 181.

BACKGROUND OF THE INVENTION

1. Field of the Invention

This invention relates to a polishing pad which is useful for creating a smooth, ultra-flat surface on such items as glass, semiconductors, dielectric/metal composites, and integrated circuits. More particularly, the invention relates to a molded polishing pad having a window which facilitates inspection of a workpiece and determination of a polishing endpoint by optical means.

2. Discussion of Related Art

Semiconductor wafers having integrated circuits fabricated thereon must be polished to provide a very smooth and flat wafer surface which in some cases may vary from a given plane by as little as a fraction of a micron. Such polishing is usually accomplished in a chemical-mechanical polishing (CMP) operation which utilizes a chemically active slurry that is buffer against the wafer surface by a polishing pad.

One problem associated with chemical-mechanical polishing is determining when the wafer has been polished to the desired degree of flatness. Conventional methods for determining a polishing endpoint require that the polishing operation be stopped and that the wafer be removed from the polishing apparatus so that dimensional characteristics can be determined. Stopping the operation slows down wafer production. Further, if a critical wafer dimension is found to be below a prescribed minimum, the wafer may be unusable, thereby leading to higher scrap rates and production costs.

In-process methods for determining polishing endpoint have also been developed. One such method utilizes laser interferometry wherein light generated by a laser is used to measure a wager dimension. See, for example, U.S. Pat. No. 5,413, 941.

Polishing pads have been developed with features that facilitate the determination of wafer dimensional characteristics by optical methods. U.S. Pat. No. 5,605,760 discloses a polishing pad wherein at least a portion of the pad is transparent to laser light over a range of wavelengths. In one embodiment, the entire polishing pad is a transparent sheet which may be made out of any solid uniform polymer including polyurethanes, acrylics, polycarbonates, nylons and polyesters. In another embodiment, the polishing pad includes a transparent window piece in an otherwise opaque pad. The window piece may be a rod or plug of transparent polymer material in a molded polishing pad. The rod or plug may be insert molded within the polishing pad, or may be installed into a cutout in the polishing pad after the molding operation.

U.S. Pat. No. 5,893,796 also discloses a polishing pad having a window piece provided by a transparent plug. The plug may be preformed as a solid insert that is molded into the pad. Alternatively, the plug may be formed by pouring liquid polyurethane into a hole that has been cut into the polishing pad, and the polyurethane may be cured to form a transparent plug within the pad.

The prior art polishing pads having transparent window pieces have a number of disadvantages. Manufacturing steps are required to either install the window piece into a hole in the pad, or into the mold cavity in which the pad is produced. In some cases a hole to receive the window piece must be cut into the pad. Leakage of slurry between the pad and the window piece may be a problem. Also, since the window material is different than the pad material, the window and the pad may wear at different rates. This may lead to cracking or tearing of the pad around the window during polishing. There is a need for a polishing pad having a transparent window that overcomes these problems.

SUMMARY OF THE INVENTION

A polishing pad according to the invention comprises a one-piece molded article made of polymeric material. The article has a region wherein the polymeric material is transparent, and an adjacent region wherein the polymeric material is opaque. The polishing pad is useful for polishing a workpiece in conjunction with an optical detection system that can determine a polishing endpoint for the workpiece. The transparent region of the polishing pad is sufficiently transmissive to permit incident radiation used for polishing endpoint detection to pass through the polishing pad.

The polishing pad is formed by solidifying a flowable polymeric material which at least initially has a uniform composition. The polymeric material is processed during a molding operation to provide the transparent region and the adjacent opaque region.

Types of polymeric material suitable for making the polishing pad include a single semi-crystalline thermoplastic material, a blend of thermoplastic materials, and a reactive thermosetting polymer.

A method of making a polishing pad comprises:

providing a mold having a mold cavity;

delivering a flowable polymeric material into the mold cavity, wherein the flowable polymeric material is transparent;

cooling the flowable polymeric material in a region of the mold cavity at a relatively rapid rate, wherein the polymeric material in the region hardens and remains transparent after hardening; and cooling the flowable polymeric material in an adjacent region of the mold cavity at a relatively slower rate, wherein the polymeric material in the adjacent region hardens and becomes relatively opaque.

BRIEF DESCRIPTION OF THE DRAWINGS

The invention will now be described by way of example with reference to the accompanying drawings wherein.

DETAILED DESCRIPTION OF A PREFERRED EMBODIMENT

Figure 1:
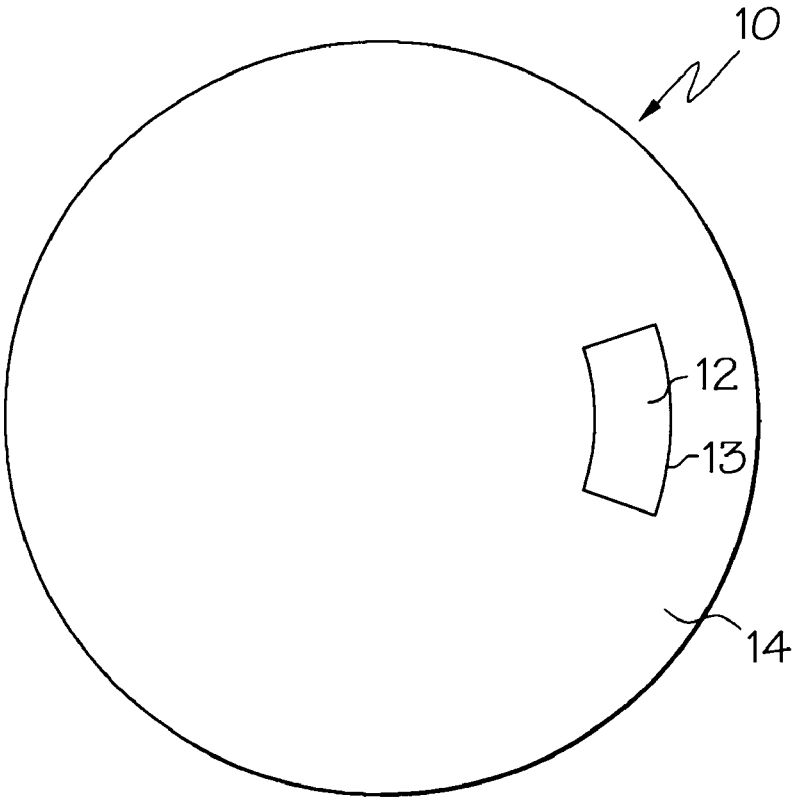
FIG. 1 is a top plan view of a polishing pad according to the invention.

A polishing pad according to the invention as shown in FIG. 1 comprises a one-piece molded article 10 which is shaped as a substantially flat disk having opposite major surfaces. One of the major surfaces is a polishing surface that is applied to a workpiece during polishing, and the other major surface is a back surface that is contacted by a platen on which the polishing pad is mounted, either directly or through an intermediate base pad.

The molded polishing pad is characterized by a region 12 wherein the polymeric material is transparent. By transparent it is meant that the region exhibits transmissivity on the order of 20% or more to an incident light beam having some wavelength in the range from infrared to ultra-violet, at least when the light beam is at an angle of incidence substantially normal to the surface of the polishing pad. It should be understood that the transparent region need not be totally transmissive, and that some scattering of incident light, particularly due to surface finish of the transparent region, is acceptable.

A region 14 of the polishing pad which is adjacent to the transparent region 12 is substantially opaque. In a preferred embodiment the entire polishing pad is opaque except for the transparent region 12. However, the polishing pad may comprise two or more transparent regions, in which case each of the transparent regions stands in contrast to an adjacent opaque region. It should be understood that the opaque region 14 need not be completely opaque to incident light, particularly since the polishing pad is relatively thin, having a thickness dimension on the order of 0.050 to 0.080 inch. It is only required that the opaque region 14 be relatively less transmissive than the transparent region 12.

The transparent region 12 is delineated by a boundary 13 that may have any desired configuration within the opaque region 14. Since the transparent region 12 and the opaque region 14 are integrally molded from the same polymeric material formulation, the boundary 13 is merely a transition between regions having different light-transmissive properties, and as such the boundary 13 is not a distinct structure.

The pad is made by solidification of a flowable polymeric material, or a mixture of flowable polymeric materials, which initially is transparent and, at least prior to solidification, has a uniform composition. The transparent region 12 is formed by processing the flowable polymeric material so that a portion of the polymeric material retains its transparency after solidification.

One type of polymeric material suitable for making the pad comprises semi-crystalline thermoplastic polymers. These polymers are generally transparent when in liquid phase but become opaque after curing because they contain both crystalline and amorphous phases, and the crystalline phase causes light-scattering which makes the polymer opaque. Crystallization occurs at temperatures between the melting temperature ($T_{melt}$) and the glass transition temperature ($T_g$) of the polymer, these being the upper and lower crystallization temperatures, respectively. If a semi-crystalline polymer is rapidly cooled from a temperature above $T_{melt}$ to a temperature below $T_g$, crystallization can be minimized, and the polymer will remain amorphous and transparent. Alternatively, crystallization can be controlled by rapid cooling in order to keep the resulting crystallite to a size which is too small to scatter light, whereby the polymer will remain transparent.

Thus, a polishing pad according to the invention may be produced by molding a semi-crystalline polymeric material in a mold having a mold cavity, wherein the mold has a means for rapidly cooling the polymeric material in a section of the mold cavity. The semi-crystalline polymeric material is delivered to the mold cavity in a liquid phase and is transparent. A means for rapidly cooling the material may comprise a passageway in the mold which permits circulation of a cooling medium such as chilled water or air, thereby removing heat from a region of the polymeric material proximate to the passageway. The polymeric material in this region is rapidly cooled from a temperature above $T_{melt}$ to a temperature below $T_g$, thereby constraining the crystallization process as discussed above and retaining the transparency of the material in this region.

Another suitable type of polymeric material for making the pad comprises a blend of two thermoplastic polymers. Again it is possible to control opacity by controlling cooling rates in different regions of the mold. Polymer blends typically have temperature ranges within which they are either miscible (single phase and transparent) or immiscible (incompatible and opaque). An example of such a system is poly (phenylene oxide)—polystyrene blends. These two polymers are completely miscible at elevated temperature. A slow cooling of the blend allows phase separation and opacity develops. However, rapid cooling will freeze-in the transparent single phase structure.

Another suitable type of polymeric material comprises a reactive thermosetting polymer which forms phase separated micro-domains. Such a polymer comprises a polyol and a polydiamine which are mixed and reacted with an isocyanate.

The following example describes the formation of a polishing pad having a transparent window in which a polymeric material comprising a reactive thermosetting polymer forms phase separated domains during pad formation.

Two liquid streams are mixed together and injected into a closed mold having a shape corresponding to a desired pad shape. The first stream comprises a mixture of a polymeric diol and a polymeric diamine, together with an amine catalyst. The ratio of diol to diamine is variable over a wide range (5% to 95%) and is determined by the required physical properties of the final pad. Likewise, the molecular weights of the diol and diamine are not critical to this invention, and these also may be determined by the required physical properties of the pad.

The second stream comprises a diisocyanate, preferably diphenylmethanediisocyanate (MDI). The amount of diisocyanate used is such as to give a slight excess after complete reaction with the diol and diamine groups. This is standard practice to those skilled in the art of urethane manufacture.

The mixed streams are injected into a heated mold to form a phase separated polyurethane-urea polymeric material. Overall mold temperature is between 50° C. and 120° C. The mold is designed with an isolated temperature zone, on both sides of the mold, that has independent temperature control, corresponding to the shape and location of the desired transparent window. The temperature of this zone is initially 20° C. and 50° C. lower than the temperature of the surrounding mold.

Soon after the mold is completely filled, the reactive polymer gels. After gelation, the relatively cooler isolated temperature zone is heated to approximately the same temperature as the rest of the mold to complete polymerization of the part. After the required polymerization time has elapsed, the part, in the form of a net-shaped pad, is subsequently demolded. The pad is generally opaque but has a transparent window region corresponding to the relatively cooler zone in the mold cavity.

Molding processes in accordance with the invention include thermoplastic injection molding, thermoset injection molding (often referred to as "reaction injection molding" or "RIM"), thermoplastic or thermoset injection blow molding, compression molding, or any similar-type process in which a flowable material is positioned and solidified.

A polishing pad according to the invention has a number of advantages. The pad is molded as a one-piece article with an integral, transparent window, thereby reducing manufacturing steps and associated costs. The possibility of slurry leakage around the window is eliminated. The window is coplanar with the polishing surface so that a surface of the window can participate in the polishing. Since the window is made from the same polymer formulation as the rest of the pad, the window has the same physical properties as the pad. Therefore, the window has the same conditioning and polishing characteristics and the same hydrolytic stability as the pad. Further, thermal expansion mismatch between the pad and the window is avoided.

The invention having been disclosed, a number of variations will now become apparent to those skilled in the art. Whereas the invention is intended to encompass the foregoing preferred embodiments as well as a reasonable range of equivalents, reference should be made to the appended claims rather than the foregoing discussion of examples, in order to assess the scope of the invention in which exclusive rights are claimed.

We claim:

1. A method of making a polishing pad comprising:

molding a flowable polymeric material to the shape of a polishing pad in a mold cavity of a molding apparatus, wherein the flowable polymeric material is transparent in a flowable state;

cooling the flowable polymeric material in a first region of the mold cavity at a relatively rapid rate, to solidify the polymeric material in the first region to a relatively transparent state, and cooling the flowable polymeric material in an adjacent region of the mold cavity at a relatively slower rate, to solidify the polymeric material in the adjacent region to a relatively opaque state.

2. The method of claim 1 wherein the flowable polymeric material is substantially a single thermoplastic material, and the step of cooling the flowable polymeric material in the first region further comprises the step of; rapidly cooling to a temperature below the crystallization temperature to minimize crystallization, and to maintain the polymer substantially amorphous and transparent.

3. The method of claim 1 wherein the flowable polymeric material is substantially a single thermoplastic material, and the step of cooling the flowable polymeric material in the first region further comprises the step of; rapidly cooling to a temperature below the crystallization temperature to solidify the single thermoplastic material to a crystallite size which is too small to scatter light.

4. The method of claim 1 wherein the flowable polymeric material is substantially a blend of miscible thermoplastic materials, and the step of cooling the flowable polymeric material in the first region further comprises the step of; rapidly cooling to a temperature below which the miscible thermoplastic polymers solidify into immiscible, phase separated polymers, which prevents phase separation of the miscible thermoplastic polymers.

5. The method of claim 1 wherein the flowable polymeric material is substantially a reactive thermosetting polymer which solidifies to form phase separated micro-domains, and the step of cooling the flowable polymeric material in the first region, further comprises the step of; rapidly cooling to a temperature below which the reactive thermosetting polymer forms phase separated micro-domains.

* * * * *